US007845993B2

(12) United States Patent
Falchetti

(10) Patent No.: US 7,845,993 B2
(45) Date of Patent: Dec. 7, 2010

(54) FEMALE ELECTRICAL TERMINAL

(75) Inventor: Antonio Falchetti, Codogno (IT)

(73) Assignee: MTA S.p.A., Codogno (IT)

( * ) Notice: Subject to any disclaimer, the term of this patent is extended or adjusted under 35 U.S.C. 154(b) by 0 days.

(21) Appl. No.: 12/626,789

(22) Filed: Nov. 27, 2009

(65) Prior Publication Data

US 2010/0190388 A1 Jul. 29, 2010

(30) Foreign Application Priority Data

Jan. 23, 2009 (EP) ..... 09425015

(51) Int. Cl.
*H01R 13/187* (2006.01)

(52) U.S. Cl. ..... 439/843; 439/845; 439/849

(58) Field of Classification Search ..... 439/843, 439/845–847, 849, 850
See application file for complete search history.

(56) References Cited

U.S. PATENT DOCUMENTS 3,228,207 A * 1/1966 Hartmann, Jr. et al. ..... 439/849
5,639,270 A 6/1997 Barbieri et al.
2008/0293287 A1 11/2008 Zinn

FOREIGN PATENT DOCUMENTS

| | | |
|---|---|---|
| EP | 1 100 492 | 5/2000 |
| EP | 1 429 424 | 6/2004 |
| FR | 2 647 602 | 11/1990 |

OTHER PUBLICATIONS

European Search Report for EP 09425015.6, dated Jun. 26, 2009.

* cited by examiner

*Primary Examiner*—Tho D Ta
(74) *Attorney, Agent, or Firm*—Nixon & Vanderhye PC

(57) ABSTRACT

The present invention relates to a female electrical terminal destined to couple with a male blade terminal (60), comprising a body (12) equipped with a bottom wall (15) having projections (18-21) for the electrical contact with the male terminal and two side walls (16, 17) defining with the bottom wall a housing seat (14) for the male terminal, the female terminal comprising a pushing elastic element (28) suitable for use to push the male terminal towards said bottom wall (15). Said contact projections (18-21) are at least four, the terminal comprising a shell (26) carrying the pushing elastic element (28) and being equipped with portions (31-34) for coupling with said body (12) that externally embrace said two side walls (16-17) of the body.

8 Claims, 3 Drawing Sheets

FEMALE ELECTRICAL TERMINAL

This application claims priority to European Application No. 09425015.6, filed 23 Jan. 2009 the entire content of which is hereby incorporated by reference.

TECHNICAL FIELD

The present invention relates to a female electrical terminal, of the kind suitable for engaging with a male blade terminal.

BACKGROUND OF THE INVENTION

Producing female terminals comprising a conductive-material body which, on one side, is provided with means for connecting to an electric cable and, on the opposite side, forms a housing seat for a male blade terminal is known in the art. The seat is provided by a bottom wall of the body and two side walls projecting from opposite sides of the bottom wall. The upper ends of the side walls are folded one towards the other to define an undercut. In the bottom wall there are three projections forming electrical contact points with the male blade terminal.

The female terminals of the known art further comprise an elastic element destined to push the blade male towards the bottom wall of the seat so as to produce the electrical contact with the contact projections. The elastic element consists of a tongue which is inserted into the seat under the undercut-folded ends of the body side walls. Such a terminal may be destined, in particular, to the automotive field, and is described in the international application WO 2008/120048.

These known terminals provide, however, some drawbacks.

In fact, the elastic element rests on the inner walls of the seat consisting of the terminal body and, upon insertion of the male terminal blade into its respective seat, it may place and deform in an undesired way. This prevents from reliably generating an impulse force towards the contact projections with optimal intensity and direction, thus invalidating the quality of the electrical contact, for example reducing the overall contact area.

Furthermore, the terminal structure is relatively complex and its assembly results in being expensive.

SUMMARY OF THE INVENTION

The general object of the present invention is to overcome the above-mentioned drawbacks by providing a female electrical terminal allowing to reliably ensure a satisfying contact between male and female.

A further object of the invention is to provide a female electrical terminal which is cost-effective, easy to assembly and has a simple structure.

In view of such object it has been thought to produce, according to the invention, a female electrical terminal destined to couple with a male blade terminal, comprising:

- a body comprising a bottom wall which has projections for the electrical contact with the male terminal and two opposite side walls which define with the bottom wall a seat for housing the male terminal, and
- a pushing elastic element suitable for use to push the male terminal towards said bottom wall, wherein said contact projections are at least four, and wherein the female electrical terminal comprises a shell which carries the pushing elastic element and is equipped with portions for coupling with said body that externally embrace said two side walls of the body.

BRIEF DESCRIPTION OF THE DRAWINGS

In order to clarify the explanation of the novel principles of the present invention and its advantages with respect to the known art, a possible exemplifying embodiment applying such principles will hereinafter be described, with reference to the annexed drawings. In the drawings.

DETAILED DESCRIPTION OF THE PREFERRED EMBODIMENTS

Figure 1:
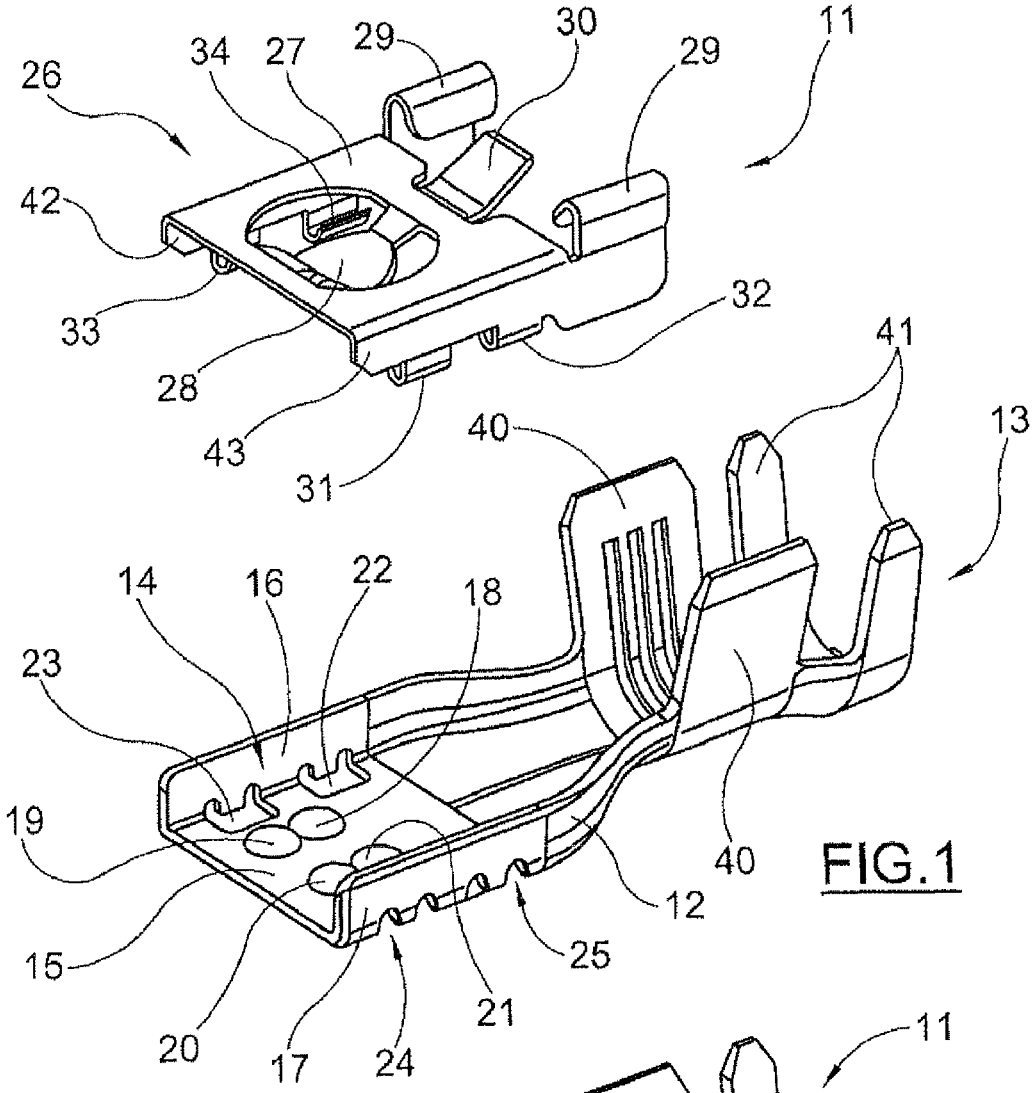
FIG. 1 shows an exploded perspective view of a terminal according to the invention.

FIG. 1 shows the female terminal 11, for example destined to be used in the automotive field.

The terminal 11 comprises a body 12 and an upper shell 26. The body 12 is made of a conductive material and comprises means 13 for the connection to an electric cable (not shown in the Figure). In the embodiment shown in the Figure, the connection means 13 comprise two foldable fins 41 to tighten on the cable sheathing, and two tongues 40 foldable on the cable conductor.

On the opposite side with respect to the means 13, the body 12 comprises a bottom wall 15 and two side walls 16, 17 projecting from opposite sides of the wall 15 in a transverse direction with respect thereto. The bottom wall 15 and the side walls 16, 17 define a seat 14 for housing the male blade terminal, destined to insert in the seat along a direction parallel to walls 16, 17.

The bottom wall 15 is equipped with four projections 18-21 destined to contact with the male blade terminal. The projections are advantageously placed at the corners of a rectangle, and are aligned in pairs along a direction transverse to the insertion direction of the male terminal into the seat. The projections 18-21 are formed as rounded drawings from the bottom wall 15, preferably shaped as sphere portions.

The body 12 further comprises four seats 22-25 destined to receive in engagement corresponding coupling portions 31-34 of the upper shell 26. Advantageously, the seats 22-25 are made as through holes in correspondence of the union between the side walls 16, 17 and the bottom wall 15.

The upper shell 26 carries a pushing elastic element 28, destined for use to push the male terminal towards the contact projections 18-21 of the bottom wall 15. The shell 26 further comprises the portions 31-34 coupling to the body 12.

In the embodiment shown in the Figure, the shell 26 comprises wall 27 oriented, once completed the assembly, parallel to the bottom wall 15, and two side walls 42, 43 projecting transversely of wall 27 on opposite sides. On the walls 42, 43 the coupling portions 33, 34 and 31, 32, respectively, are formed in the form of arms folded towards the inside of the shell to graft onto the seats 21-25 of the body 12.

The elastic element 28 is integral with the shell 26, advantageously in the form of a warped portion 28 connected to the wall 27 in correspondence of two of its ends aligned along the insertion direction of the male terminal into its respective seat.

The shell 26 further comprises an upwardly folded tongue 30, destined to anchor the terminal in a connector case (not shown), and two projections 29 placed on opposite sides of the tongue 30. The projections 29 function to protect the tongue 30 and to polarize.

Figure 2:
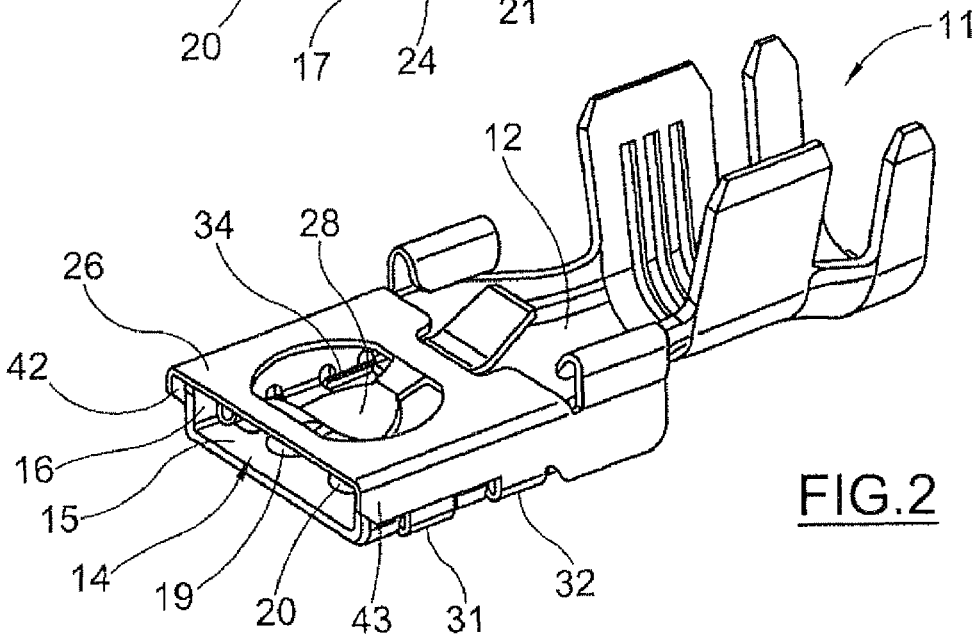
FIG. 2 shows a perspective view of the terminal in assembled condition.

FIG. 2 shows the terminal 11 in assembled condition, with the shell 26 applied to the body 12. The walls 42, 43 embrace on opposite sides the side walls 16, 17 of the body 12 and the coupling portions 31-34 engage with the seats 22-25. The upper ends of the side walls 16, 17 rest against the wall 27 of the shell. The assembly is effortless and can be made by coupling the two pieces along a direction transverse to the bottom wall 15. Initially, when the shell 26 is superposed to the body 12, the ends of the portions 31-34 are not folded, but straight; afterwards, such ends are folded to engage the seats 22-25.

Figure 3:
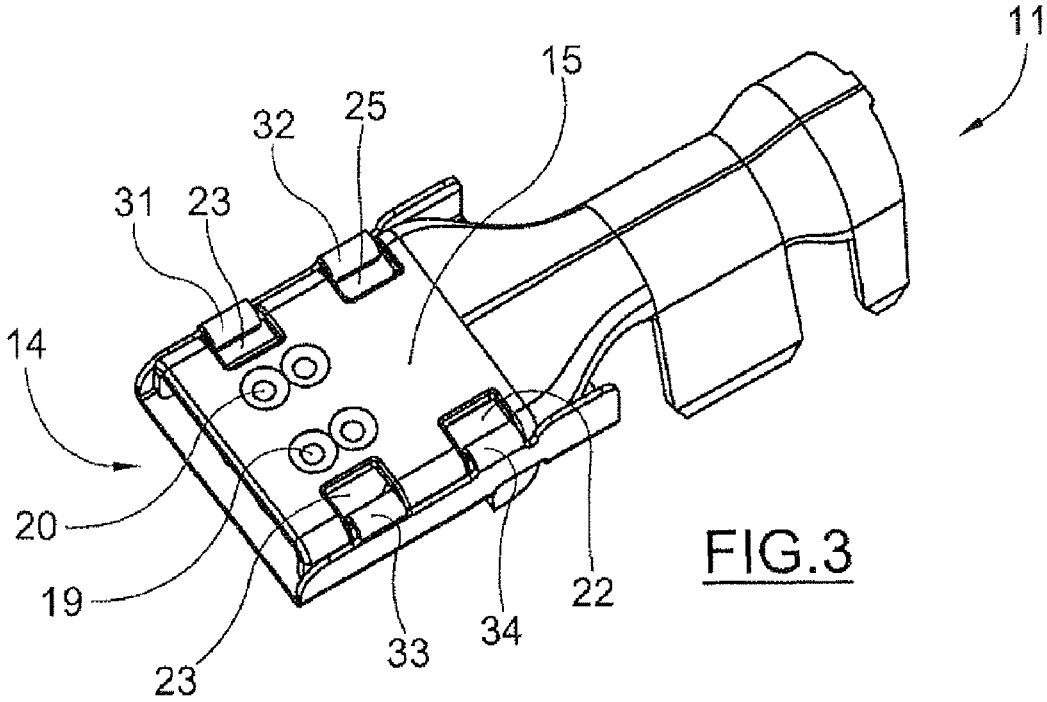
FIG. 3 shows a perspective view of the lower side of the terminal of the previous Figures.

In FIG. 3 the drawings forming the contact projections in the bottom wall 15 of the body 12 are clearly shown.

Figure 4:
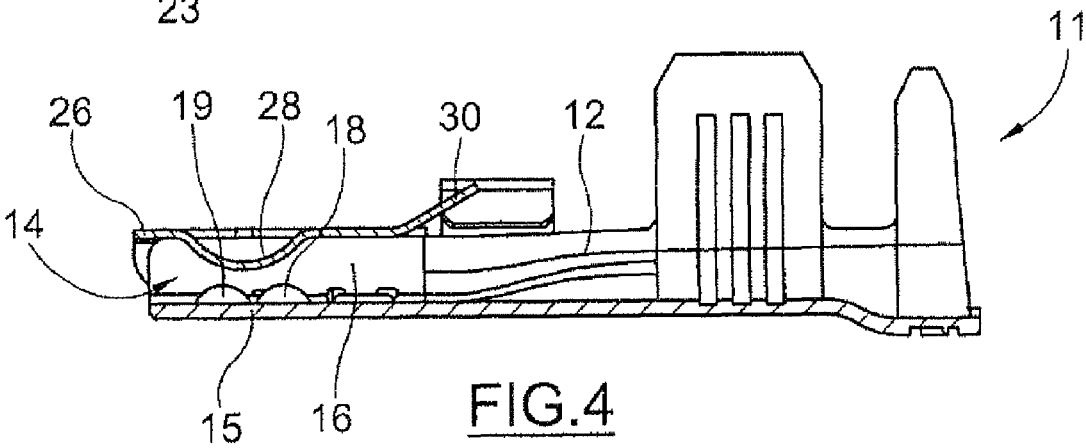
FIG. 4 shows a longitudinal sectional view of the terminal prior to the insertion of the male blade terminal.
Figure 5:
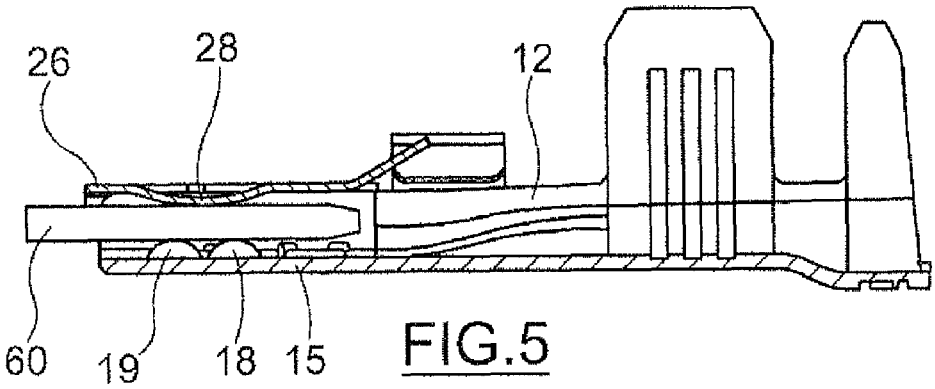
FIG. 5 shows a sectional view equal to the previous one with the male terminal inserted.

FIG. 4 shows the warped elastic element 28, the lower end of which is placed between the projections 18, 19, 20 and 21. Such lower end corresponds to the contact point with the blade of the male terminal and identifies the direction of the force applied to such terminal. Such force is applied perpendicularly to the bottom wall 15 with direction going through the barycentre of the rectangle defined by the projections 18-21. The correct positioning of the elastic element 28 is ensured by the coupling means 31-34, acting on the exterior of the body 12. The push is oriented in a reliable way to ensure an optimal contact between the projections 18-21 and the male terminal 60, shown in FIG. 5.

In particular, the arrangement of the elastic element and contact projections allows to obtain a wide contact surface between the terminals, avoiding local overheating. The male terminal 60 has a flat form as the seat 14, and upon its insertion into the seat the spring 28 and/or the shell 26 buckle in a reliable and predetermined way.

The upper shell 26 can be advantageously made of steel. Both the body 12 and the shell 26 are advantageously obtained by moulding and folding of a metal foil.

It is to be noted that the protection and polarization projections 29 may also not be present in the terminal. Also the fin 30 may be absent, and other anchoring systems to the connector case may be used.

Figure 6:
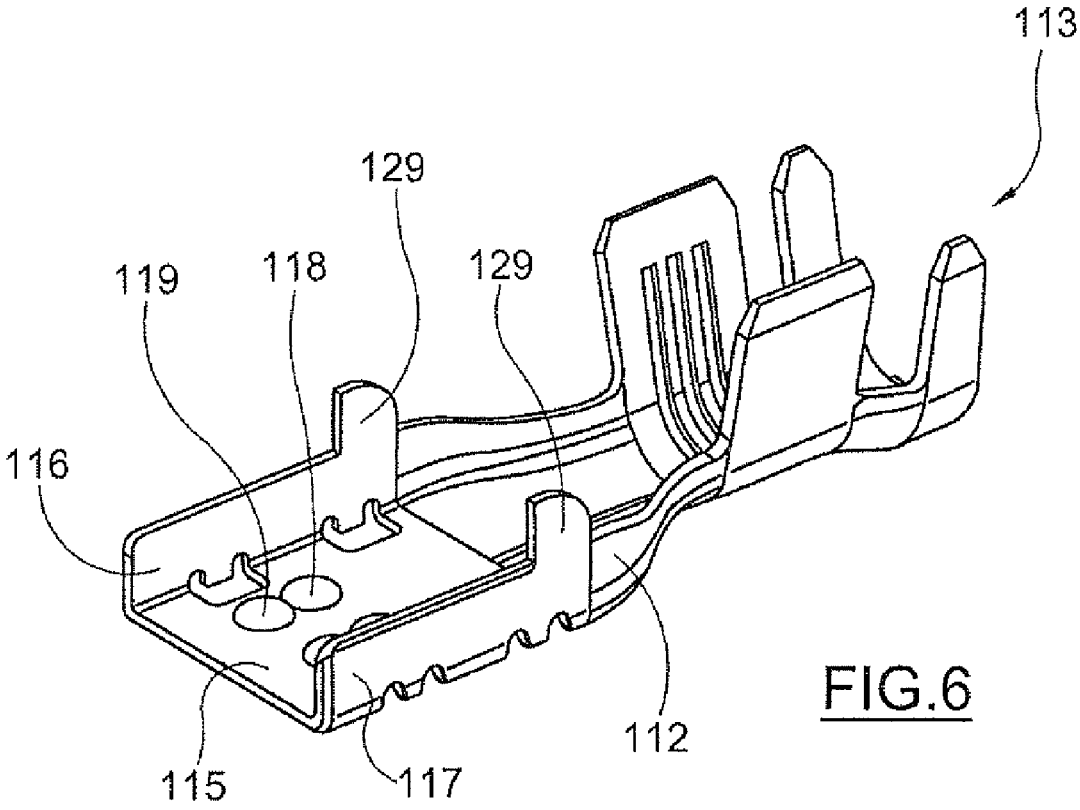
FIGS. 6 and 7 show an alternative embodiment of the terminal according to the invention.
Figure 7:
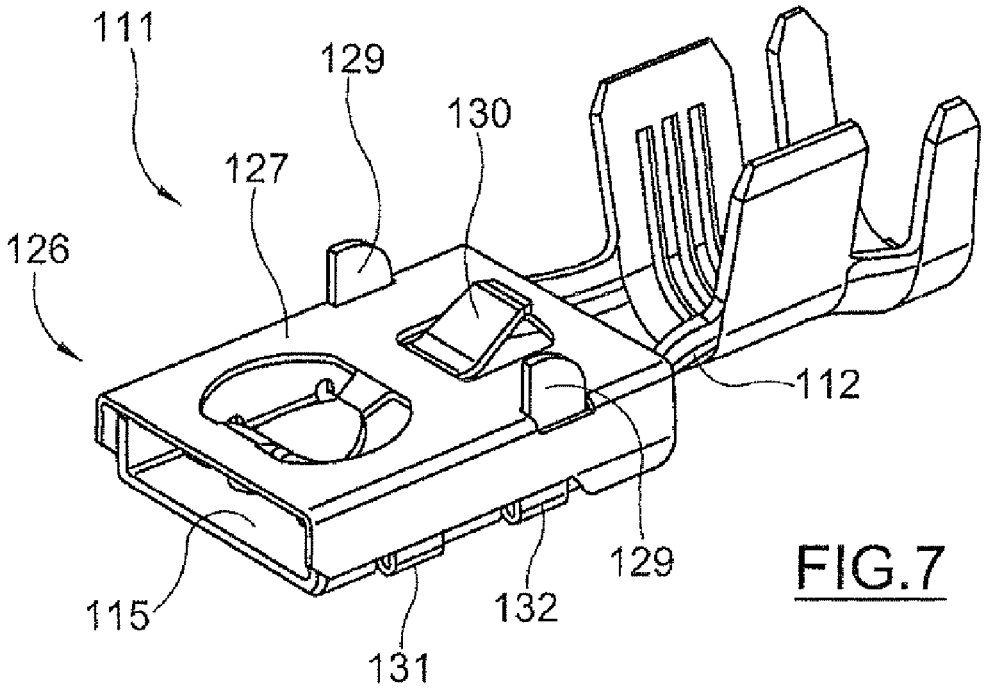

FIGS. 6 and 7 show an alternative embodiment of a terminal 111 according to the invention, wherein the elements corresponding to elements of the first embodiment have been indicated with reference numerals increased by 100.

The alternative embodiment differs from the previously-described one only in that the protection and polarization fins 129 placed on opposite sides of the tongue 130 are integral with the body 112, and not with the upper shell 126. The fins 129 project from the side walls 116, 117 of the body 112 so as to insert in corresponding openings formed on the external shell 126, projecting upwardly with respect to the wall 127 and next to the tongue 130 as well shown in FIG. 7.

At this point it is apparent how the objects of the present invention have been reached.

In particular, a female electrical terminal is provided, which allows to obtain a satisfying electrical contact with a male blade terminal in a reliable way.

The terminal is furthermore cost-effective, has a simple structure and is easy to assembly.

Of course, the above description of one embodiment applying the novel principles of the present invention is given by way of example of such novel principles and has therefore not to be considered as a limitation of the patent scope herein claimed.

I claim:

1. A female electrical terminal destined to couple with a male blade terminal, comprising:

a body comprising a bottom wall which has projections for the electrical contact with the male terminal and two opposite side walls which define with the bottom wall a seat for housing the male terminal, and a pushing elastic element suitable for use to push the male terminal towards said bottom wall, wherein said contact projections are at least four, and wherein the female electrical terminal comprises a shell which carries the pushing elastic element and is equipped with portions for coupling with said body that externally embrace said two side walls of the body, wherein the elastic element comprises a warped portion connected to said shell in correspondence of two of its opposite ends aligned along the insertion direction of the male terminal into its respective seat, wherein the cross section of said two opposite ends of the warped portion is smaller than the cross section of a central part of the warped portion.

2. An electrical terminal according to claim 1, wherein said projections are aligned in pairs along a direction transverse to the insertion direction of the male terminal into its seat.

3. An electrical terminal according to claim 1, wherein said projections are four.

4. An electrical terminal according to claim 1, wherein said projections are placed at the corners of a rectangle.

5. An electrical terminal according to claim 1, wherein said pushing elastic element is placed so as to insist in use on the male terminal in correspondence of one of its portions placed in an area within the contact projections.

6. An electrical terminal according to claim 1, wherein the pushing elastic element is placed so as to generate a force practically directed towards the barycentre of the polygon defined by the contact projections.

7. An electrical terminal according to claim 1, wherein the coupling portions comprise arms folded to engage in corresponding seats accessible from outside the terminal body.

8. An electrical terminal according to claim 7, wherein said arms are four, two for each side of the terminal body.

* * * * *